US007422058B2

(12) United States Patent
O'Malley

(10) Patent No.: US 7,422,058 B2
(45) Date of Patent: Sep. 9, 2008

(54) REINFORCED OPEN-HOLE ZONAL ISOLATION PACKER AND METHOD OF USE

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 278 days.

(21) Appl. No.: 11/187,204

(22) Filed: Jul. 22, 2005

(65) Prior Publication Data

US 2007/0017683 A1 Jan. 25, 2007

(51) Int. Cl.
*E21B 23/06* (2006.01)
*E21B 33/12* (2006.01)

(52) U.S. Cl. ..... 166/187; 166/387; 166/189; 166/191; 166/195; 166/100

(58) Field of Classification Search ..... 166/387, 166/187, 189, 191, 195, 100
See application file for complete search history.

(56) References Cited

U.S. PATENT DOCUMENTS 2,701,615 A * 2/1955 Riordan, Jr. et al. ..... 166/63
3,235,017 A 2/1966 Lynes ..... 175/321
4,296,806 A * 10/1981 Taylor et al. ..... 166/120
4,403,660 A 9/1983 Coone ..... 166/387
5,010,958 A 4/1991 Meek et al. ..... 166/382
6,182,755 B1 2/2001 Mansure ..... 166/180
6,796,376 B2 9/2004 Frazier ..... 166/134
6,827,150 B2 12/2004 Luke ..... 166/387
2002/0157867 A1* 10/2002 Moore ..... 175/20
2004/0026092 A1* 2/2004 Divis et al. ..... 166/387
2004/0238168 A1* 12/2004 Echols ..... 166/278
2005/0072579 A1* 4/2005 Gambier ..... 166/387

FOREIGN PATENT DOCUMENTS

WO WO 93/06333 A 1/1993

* cited by examiner

*Primary Examiner*—Sean D Andrish
(74) *Attorney, Agent, or Firm*—Shawn Hunter

(57) ABSTRACT

A packer device and methods of use for a packer within uncased wellbore to form a complete fluid seal. The packer device includes a central mandrel body that retains a plurality of nested, telescopic expanding elements that are moveable outwardly from the mandrel body. The mandrel body and expanding elements are surrounded by a load-distributing structure as well as a sealing element, which is typically comprised of elastomer. The packer device is hydraulically actuated to urge the expansion members radially outwardly against the load-distributing structure and the sealing element. Because there are a number of discrete expansion elements, the packer device is better able to create a fluid seal within an uncased borehole with surface irregularities.

18 Claims, 3 Drawing Sheets

Fig. 1
(Prior Art)
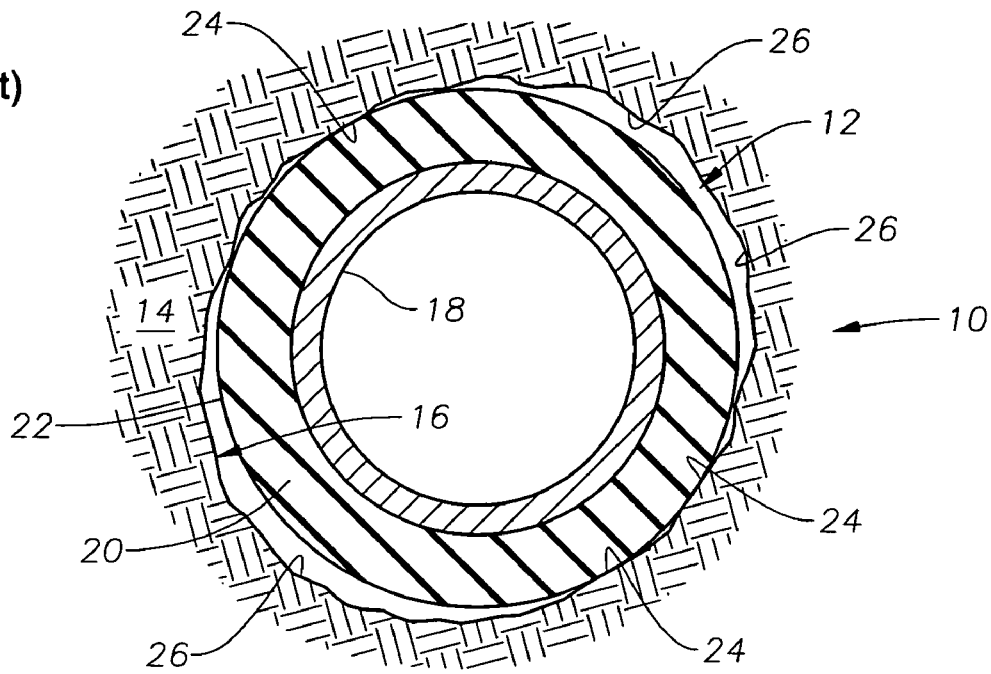
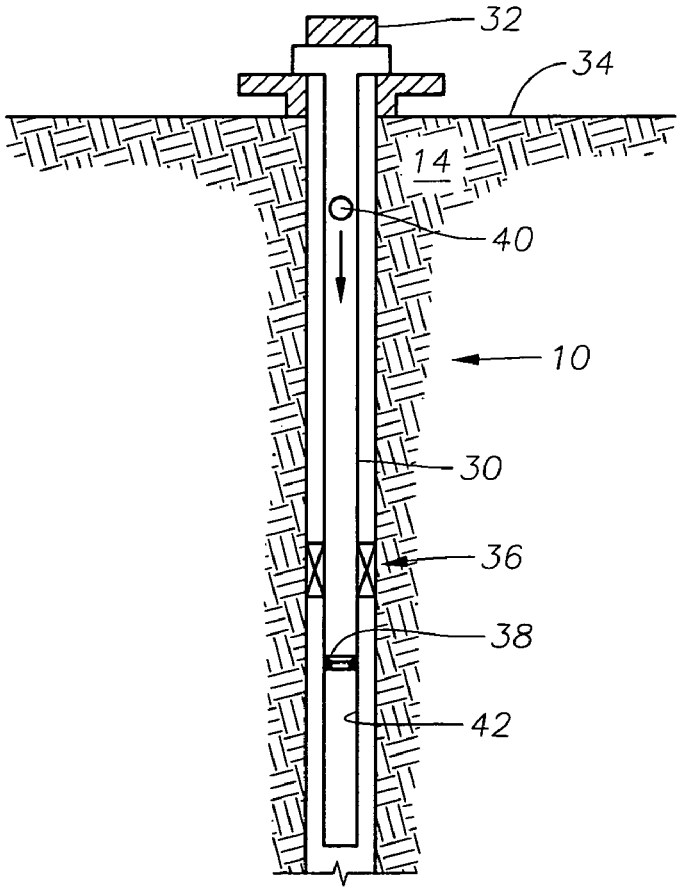
Fig. 2

REINFORCED OPEN-HOLE ZONAL ISOLATION PACKER AND METHOD OF USE

BACKGROUND OF THE INVENTION

1. Field of the Invention

The invention relates generally to the design of packer assemblies and, in particular aspects, relates to packer devices and methods that are useful in open-hole wellbore portions having irregular surfaces.

2. Description of the Related Art

Packers are devices that are selectively set within a wellbore to form a fluid seal. Ordinarily, the packer uses a sealing element formed of Nitrile or another elastomer to form the seal. An isolation packer is used to create a fluid seal barrier between two zones within a wellbore. Conventional packer designs generally fall into one of two categories: compression-type and inflatable-type packers. Compression packers essentially consist of an elastomeric packer element that surrounds a central mandrel. The packer element is compressed axially by a setting sleeve. As the element is axially compressed, it also expands radially outwardly and contacts the inner surface of the surrounding wellbore, casing, liner or other tubing. Inflatable packers also have an elastomeric packer element that surrounds a mandrel. However, the packer element is radially expanded away from the mandrel by injection of a fluid (typically air or hydraulic fluid) into a space between the packer element and the mandrel. As the packer element expands radially, it contacts that inner surface of the surrounding wellbore, casing, liner or other tubing.

A problem exists in forming fluid seal in open-hole (i.e., uncased) sections of borehole. Open-hole wellbore portions present irregular, often rough, surfaces. Conventional packers are sometimes unable to create a complete fluid seal due to the surface irregularities. Both compression and inflation type packer devices tend to expand outwardly in a uniform fashion around the mandrel. It can be difficult to create a complete seal without stressing the sealing element beyond its intended limits.

The present invention addresses the problems of the prior art.

SUMMARY OF THE INVENTION

The invention provides a packer device and methods of use for a packer device that is suitable for use within uncased wellbore to form a complete fluid seal. The exemplary packer device includes a central mandrel body that retains a plurality of nested, telescopic expanding elements that are moveable outwardly from the mandrel body. The mandrel body and expanding elements are surrounded by a reinforcing, load-distributing structure as well as a sealing element, which is typically comprised of elastomer. The packer device is hydraulically actuated to urge the expansion members radially outwardly against the load-distributing structure and the sealing element. Because there are a number of discrete expansion elements, the packer device is better able to create a fluid seal within an uncased borehole with surface irregularities.

BRIEF DESCRIPTION OF THE DRAWINGS

FIG. 1 is an axial cross-sectional view of an exemplary portion of uncased borehole being sealed by a conventional packer device.

FIG. 2 is a side, cross-section schematic view of a wellbore containing a production string that incorporates a packer device constructed in accordance with the present invention.

DETAILED DESCRIPTION OF THE PREFERRED EMBODIMENTS

Figure 4:
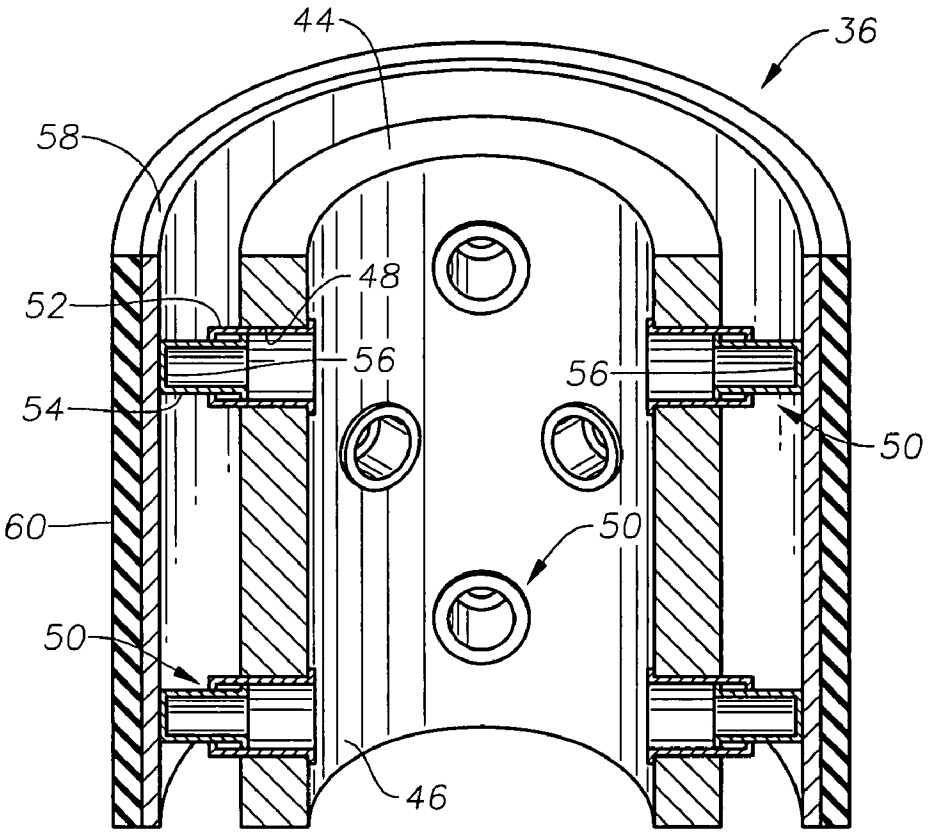
FIG. 4 is a side, partial cross-section of the isolation packer shown in FIG. 3, now in a set configuration.

FIG. 1 is a representation of a section of open-hole wellbore 10 containing a well known prior art compression-type packer device 12. The wellbore 10 has been drilled through the surrounding earth 14 and presents a rough, irregular inner surface 16. The packer device 12 includes a central mandrel 18 with surrounding packer element 20. Compression-type packer devices of this type are well-known and versions of them are described, for example, in U.S. Pat. No. 6,796,376, issued to Frazier and U.S. Pat. No. 6,827,150 issued to Luke. In FIG. 1, the outer radial surface 22 of the packer element 20 has been radially expanded out in a substantially uniform manner to contact inwardly projecting portions 24 of the inner surface 16. However, outlying portions 26 of the inner surface 16 are not contacted by the packer element 20. As a result, a complete fluid seal is not formed within the wellbore 10.

FIG. 2 is a schematic side, cross-sectional view of the exemplary uncased wellbore 10 containing a production tubing string 30 that extends from a wellhead 32 at the surface 34. As details of the construction and operation of wellheads and production strings are well understood by those of skill in the art, they will not be described in any detail herein. Incorporated into the production tubing string 30 is an isolation packer device 36, which is constructed in accordance with the present invention. Preferably, a seat 38 for a ball 40 or other plug is located within the flowbore 42 of the production tubing string 30. The seat 38 may be a pass-through ball seat of a type known in the art that will release the ball from the seat upon receipt of an overload of fluid pressure within the flowbore 42.

Figure 3:
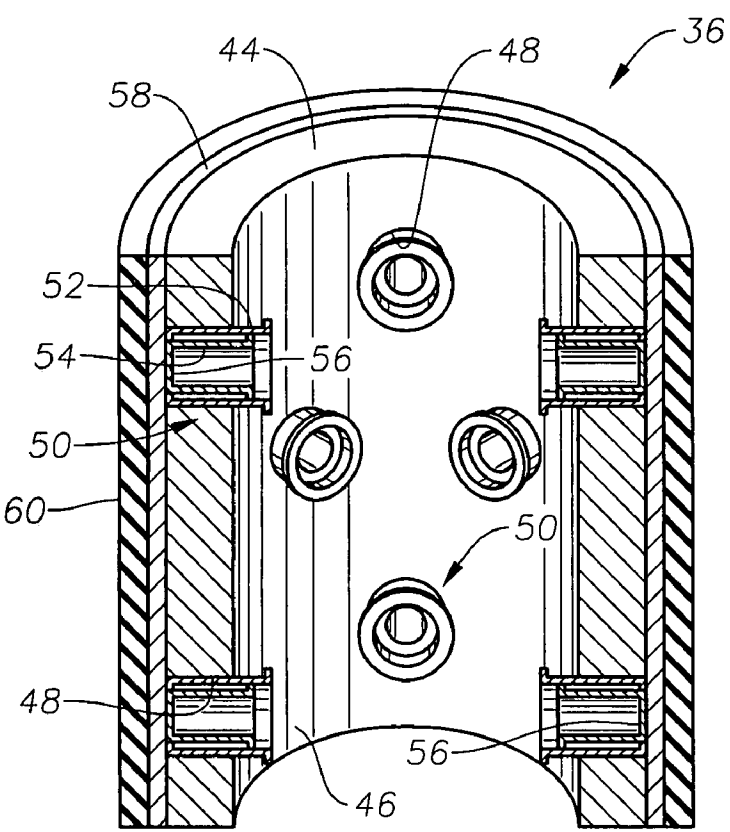
FIG. 3 is a side, partial cross-section of an exemplary isolation packer constructed in accordance with the present invention and in a run-in configuration.

FIGS. 3 and 4 illustrate the exemplary isolation packer device 36 in greater detail. FIG. 3 depicts the packer device 36 in a run-in position, prior to setting. FIG. 4 illustrates the packer device 36 after having been set. As shown, the packer device 36 includes a central packer mandrel body 44 that defines an interior axial flowbore 46. A plurality of expansion element openings 48 are disposed through the mandrel body 44. Expansion elements 50 are retained within the openings 48. While expansion elements 50 and openings 48 are shown to be substantially circular in cross-section, they may, in fact, be square, triangular, or any suitable shape.

In a currently preferred embodiment, the expansion elements 50 consist of a pair of telescoping cylinders 52 and 54 that are nested within one another. The inner cylinder 54 has a closed outer axial end wall 56. The inner cylinder 54 is capable of sliding telescopic movement with respect to the outer cylinder 52. The inner axial end of the inner cylinder 54 features an outwardly-projecting flange 55 that will abut inwardly projecting flange 57 of the outer cylinder when the inner cylinder 54 is fully extended to its radially outwardly expanded position (See FIG. 6). In addition, the outer cylinder 52 is capable of sliding telescopic movement with respect to its surrounding opening 48 and has an outwardly-projecting flange 59 proximate its inner axial end to limit its outward movement with respect to the mandrel body 44. The expansion elements 50 are moveable between a retracted position, shown in FIG. 3, and an expanded position, shown in FIG. 4. In the retracted position, the inner cylinder 54 and outer cylinder 52 are nested within one another and both are disposed within the flowbore 46 of the mandrel body 44. In the extended position, the outer cylinder 52 is extended radially outwardly from the mandrel body 44, and the inner cylinder 54 is extended telescopingly outwardly from the outer cylinder 52.

The expansion elements 50 are arranged to provide for multiple independent radial force projection points about the circumference of and along the length of the mandrel body 44. In a currently preferred embodiment, there are multiple horizontal rows of expansion elements 50 with the elements 50 in alternate rows being offset from those above and below, as shown in FIGS. 3 and 4.

A reinforcing, load-distributing structure 58 radially surrounds the mandrel body 44 and each of the expansion elements 50. In preferred embodiments, the load-distributing structure 58 comprises one or more sheets of aluminum or another suitable metal that are curved around the circumference of the mandrel body 44 in a split-ring fashion. It is currently preferred that there be multiple layers of such sheets and that the sheets overlap one another.

Surrounding the load-distributing structure 58 is a sealing element 60. The sealing element is preferably formed of elastomer. One suitable elastomeric sealing element is one formed of 60 durometer Nitrile.

Figure 6:
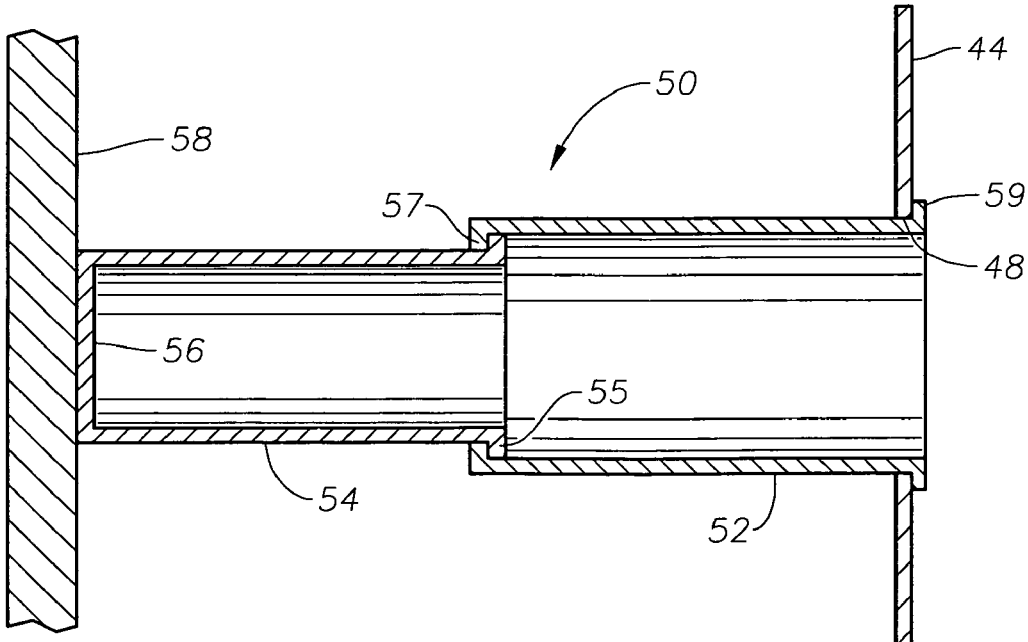
FIG. 6 is a detailed, cross-sectional view of a single expansion element used with the isolation packer device shown in FIGS. 3 and 4.

The packer device 36 is actuated hydraulically. In order to set the packer device 36, a ball or dart 40 is dropped into the flowbore 42 of the production tubing 30 and lands on the ball seat 38. Fluid pressure is built up within the flowbore 42 above the ball/dart 40. The increased fluid pressure acts upon the closed end wall 56 of the inner cylinder 54 of each expansion element 50. This urges the inner cylinders 54 outwardly with respect to the outer cylinders 52. When flange 55 of the inner cylinder 54 abuts the flange 57 of the outer cylinder 52, the outer cylinder 52 is moved radially outwardly from the mandrel body 44. FIG. 6 depicts a fully extended position for an expansion element 50. Throughout this radial expansion, the closed ends 56 of the expansion elements 50 bear upon the load-distributing structure 58 and deform it radially outwardly as necessary so that the sealing element 60 will closely conform to the contours of the surrounding borehole wall 16.

Figure 5:
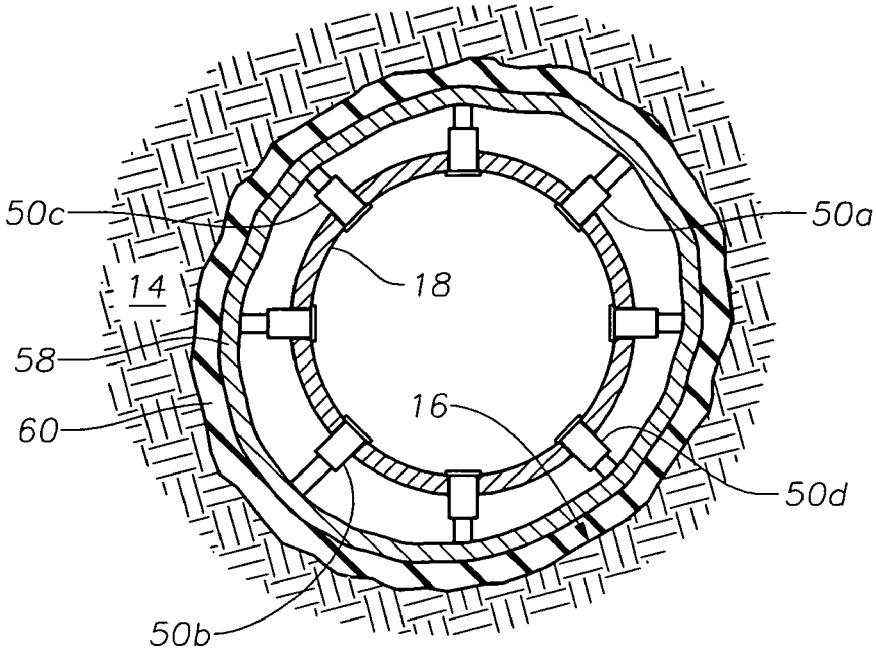
FIG. 5 is an axial cross-section showing the sealing off of a section of open-hole wellbore with the isolation packer device shown in FIGS. 3 and 4.

Telescopic movement of discrete elements allows the packer device 36 to conform more closely to the surface irregularities of the surrounding borehole wall 16. As FIG. 5 depicts, some of the expansion elements 50*a*, 50*b* are extended outwardly to a greater extent that other expansion elements 50*c*, 50*d*, due to irregularities in the borehole surface 16. As a result of this differential expansion, a more secure fluid seal is formed than with conventional packer devices.

It is noted that, although the packer device 36 is primarily designed for use in open-hole wellbore sections, it may also be used in cased wellbore sections or for sealing against other tubular members. In operation, one or more of the packer devices 36 are incorporated into the production tubing string 30 and then lowered into the wellbore 10 to the point(s) wherein it is desired to establish a fluid seal. Typically, the packer devices 36 are used to isolate production zones in the wellbore.

Those of skill in the art will recognize that numerous modifications and changes may be made to the exemplary designs and embodiments described herein and that the invention is limited only by the claims that follow and any equivalents thereof.

What is claimed is:

1. A packer device for forming a fluid seal with a wall of a wellbore, the packer device comprising:

a packer mandrel body defining an axial flowbore within;

a sealing element radially surrounding the packer mandrel body;

at least one expansion element moveably disposed within the mandrel body for selective movement radially outwardly with respect to the mandrel body to urge the sealing element into fluid sealing contact with a surrounding wellbore surface, the at least one expansion element comprising:

a first member that is moveable radially outwardly with respect to the packer mandrel body; and a second member that is nested within the first member and telescopically moveable with respect to the first member, the second member having a closed end for contacting a load-distributing structure.

2. The packer device of claim 1 further comprising a load distributing sleeve disposed between the packer mandrel body and the sealing element.

3. The packer device of claim 1 wherein there are a plurality of expansion elements.

4. The packer device of claim 1 wherein the first and second members are generally cylindrical in shape.

5. The packer device of claim 1 wherein the load-distributing structure comprises at least one sheet of metal.

6. The packer device of claim 5 wherein the sheet of metal comprises aluminum.

7. A production system for use within a wellbore, the system comprising:

a production tubing string;

a packer device incorporated into the production tubing string for forming a fluid seal with a wall of the wellbore, the packer device comprising:

a) a packer mandrel body defining an axial flowbore within b) a sealing element radially surrounding the packer mandrel body; and c) a plurality of expansion elements moveably disposed within the mandrel body for selective movement radially outwardly with respect to the mandrel body to urge the sealing element into fluid sealing contact with a surrounding wellbore surface, the expansion elements each comprising a telescopically moveable member.

8. The production system of claim 7 wherein the expansion elements comprise a pair of telescopically moveable members that are nested within one another.

9. The production system of claim 7 further comprising a load-distributing structure disposed between the expansion elements and the sealing element.

10. The production system of claim 9 wherein the load-distributing structure comprises a plurality of metal sheets wrapped around the circumference of the packer mandrel body.

11. The production system of claim 7 wherein the sealing element is comprised of elastomer.

12. The production system of claim 7 wherein the expansion elements are moved radially outwardly in response to increased hydraulic pressure within the mandrel body.

13. The production system of claim 12 further comprising a ball seat within the production tubing for landing of a ball or dart.

14. A method of forming a fluid seal with a wall of a wellbore comprising the steps of:

incorporating a packer device into a production tubing string, the packer device having:

a) a packer mandrel body defining an axial flowbore within;

b) a sealing element radially surrounding the packer mandrel body;

c) an expansion element moveably disposed within the mandrel body for selective telescopic movement radially outwardly with respect to the mandrel body to urge the sealing element into fluid contact with a surrounding wellbore surface;

disposing the production tubing string into a wellbore; and moving the expansion element radially outwardly to urge the sealing element into fluid sealing contact with a surrounding wellbore surface.

15. The method of claim 14 wherein the step of moving the expansion element radially outwardly further comprises the step of increasing fluid pressure within the production tubing string.

16. The method of claim 15 wherein the step of moving the expansion element radially outwardly further comprises landing a ball upon a ball seat within the production tubing string prior to increasing fluid pressure within the production tubing string.

17. The method of claim 14 wherein the step of moving the expansion element radially outwardly further comprises moving a first, nested member of the expansion element telescopically with respect to a second member of the expansion element.

18. The method of claim 14 wherein there are a plurality of expansion elements arranged about the circumference of the packer mandrel body.

* * * * *